US010241450B2

(12) United States Patent
Morizaki et al.

(10) Patent No.: US 10,241,450 B2
(45) Date of Patent: Mar. 26, 2019

(54) FIXING DEVICE AND IMAGE FORMING APPARATUS INCLUDING A POTENTIAL-DIFFERENCE APPLICATION UNIT

(71) Applicant: FUJI XEROX CO., LTD., Tokyo (JP)

(72) Inventors: Sou Morizaki, Kanagawa (JP); Yasutaka Gotoh, Kanagawa (JP); Jouta Kobayashi, Kanagawa (JP); Kazuaki Iikura, Kanagawa (JP); Kazuyoshi Itoh, Kanagawa (JP); Yasushi Nagata, Kanagawa (JP); Takaaki Sato, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/697,939

(22) Filed: Sep. 7, 2017

(65) Prior Publication Data

US 2018/0267445 A1 Sep. 20, 2018

(30) Foreign Application Priority Data

Mar. 17, 2017 (JP) ..... 2017-053365

(51) Int. Cl.
*G03G 15/20* (2006.01)

(52) U.S. Cl.
CPC ..... *G03G 15/2039* (2013.01); *G03G 15/2053* (2013.01); *G03G 15/206* (2013.01); *G03G 15/2032* (2013.01); *G03G 2215/2038* (2013.01)

(58) Field of Classification Search
CPC ..... G03G 15/2078; G03G 15/2053; G03G 2215/2038; G03G 15/2032; G03G 15/2089; G03G 15/2025; G03G 15/2075; G03G 2215/2035
See application file for complete search history.

(56) References Cited

U.S. PATENT DOCUMENTS 5,331,385 A * 7/1994 Ohtsuka ..... G03G 15/206 219/216
5,404,214 A * 4/1995 Yoshimoto ..... G03G 15/2064 219/216
2004/0007569 A1* 1/2004 Ohta ..... H05B 6/145 219/624
2012/0195654 A1* 8/2012 Sakakibara ..... G03G 15/2057 399/333
2014/0029992 A1* 1/2014 Yamamoto ..... G03G 15/2064 399/328
2016/0139546 A1* 5/2016 Imaizumi ..... G03G 21/203 399/322
2016/0306307 A1* 10/2016 Ishida ..... G03G 15/2053

FOREIGN PATENT DOCUMENTS

JP 2005-070602 A 3/2005
JP 2008-268728 A 11/2008

* cited by examiner

*Primary Examiner* — David M. Gray
*Assistant Examiner* — Laura Roth
(74) *Attorney, Agent, or Firm* — Sughrue Mion, PLLC

(57) ABSTRACT

A fixing device includes a heating unit that rotates and that fixes a toner image on a recording medium, a pressing unit that rotates and that presses the heating unit, and a potential-difference application unit that applies a potential difference between the pressing unit and the heating unit so that a potential of the heating unit is higher than a potential of the pressing unit.

9 Claims, 7 Drawing Sheets

FIXING DEVICE AND IMAGE FORMING APPARATUS INCLUDING A POTENTIAL-DIFFERENCE APPLICATION UNIT

CROSS-REFERENCE TO RELATED APPLICATIONS

This application is based on and claims priority under 35 USC 119 from Japanese Patent Application No. 2017-053365 filed Mar. 17, 2017.

BACKGROUND

Technical Field

The present invention relates to a fixing device and an image forming apparatus.

SUMMARY

According to an aspect of the invention, there is provided a fixing device including a heating unit that rotates and that fixes a toner image on a recording medium, a pressing unit that rotates and that presses the heating unit, and a potential-difference application unit that applies a potential difference between the pressing unit and the heating unit so that a potential of the heating unit is higher than a potential of the pressing unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings. The following exemplary embodiments are only examples of an image forming apparatus for realizing the technical idea of the present invention, but are not intended to limit the invention. The present invention may be equally applied to other exemplary embodiments included in the scope of the claims.

First Exemplary Embodiment

Figure 1:
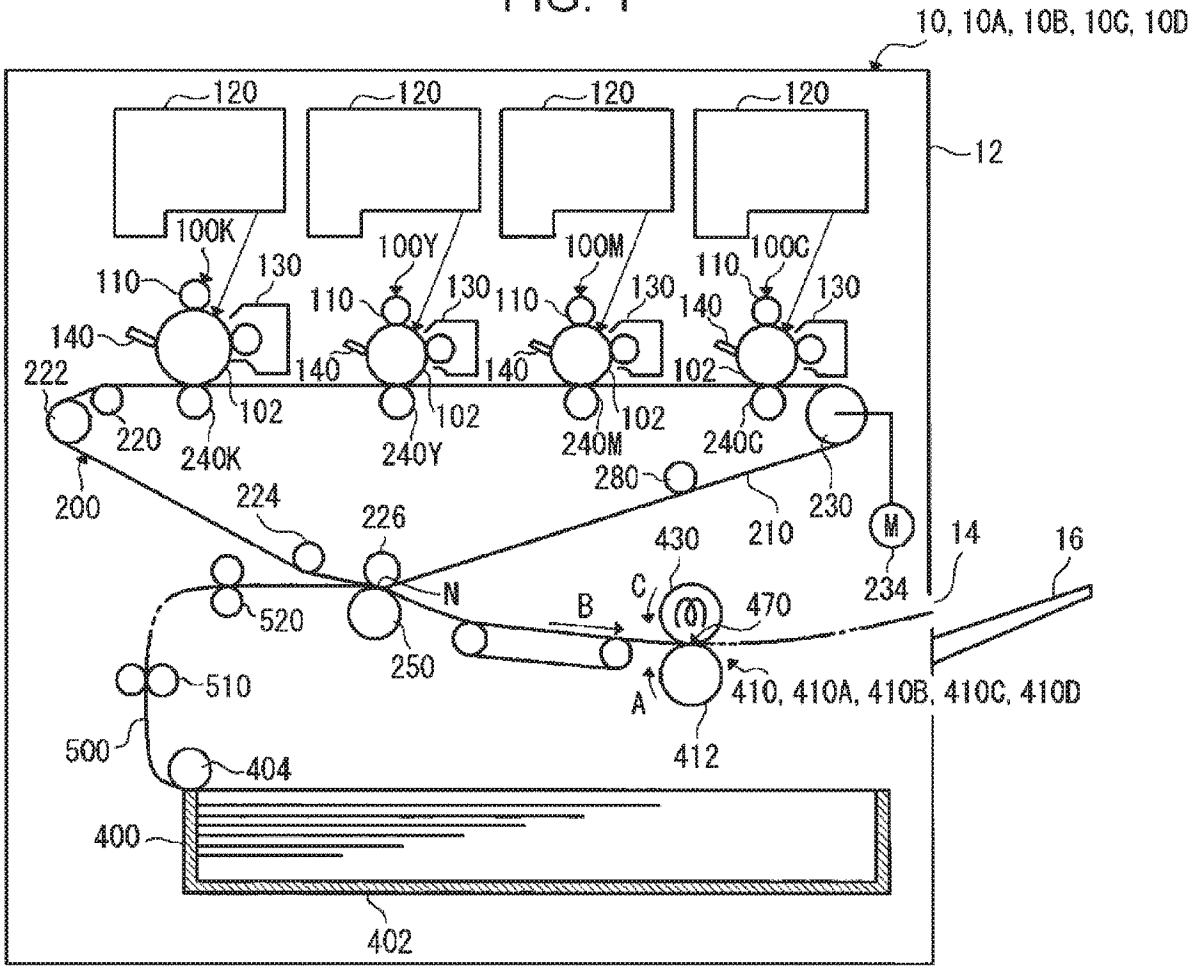
FIG. 1 is a sectional side view of an image forming apparatus according to first to fourth exemplary embodiments.
Figure 2:
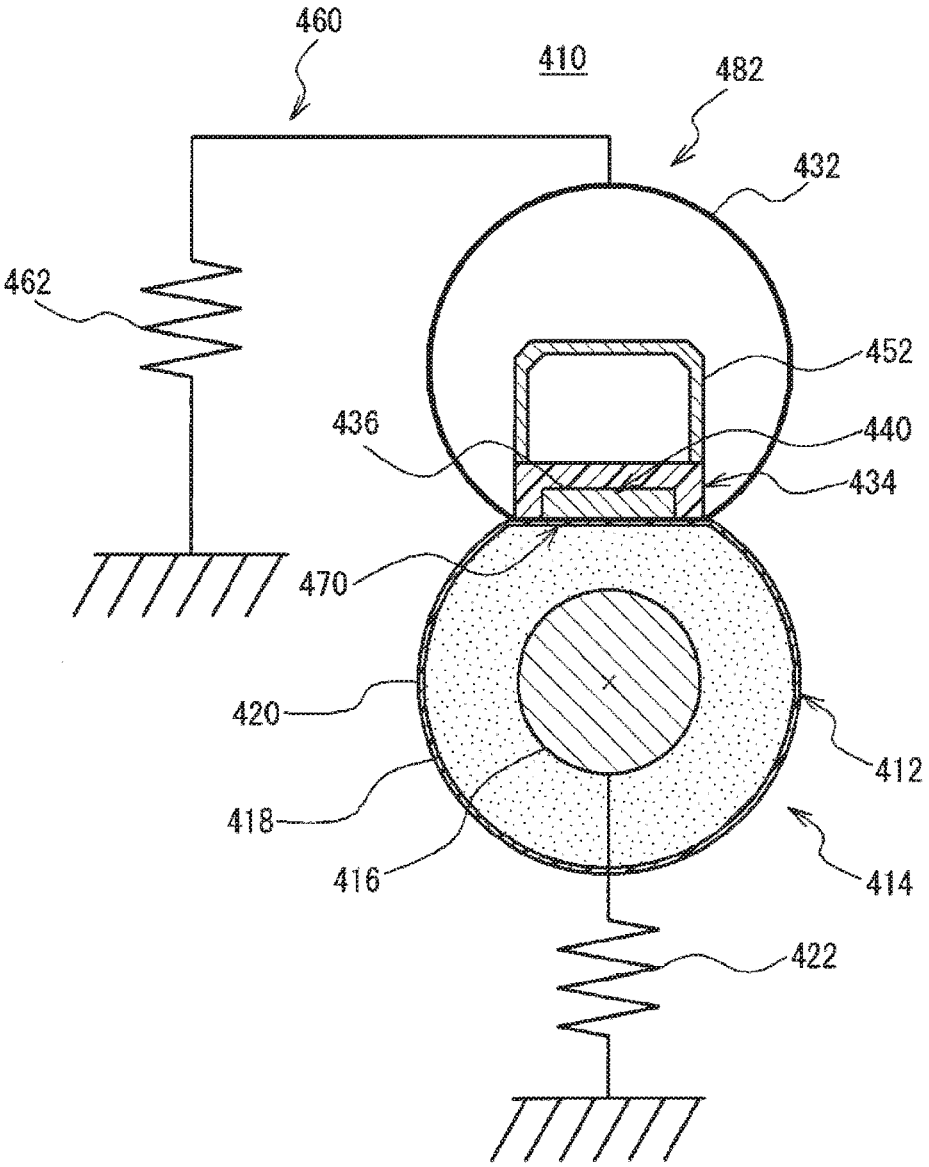
FIG. 2 is a sectional side view of a fixing device according to the first exemplary embodiment.

First, an image forming apparatus 10 according to a first exemplary embodiment will be described with reference to FIGS. 1 to 3. As illustrated in FIG. 1, the image forming apparatus 10 according to the first exemplary embodiment has an image forming apparatus body 12, and includes, inside the image forming apparatus body 12, an image forming unit 100K that forms a black toner image, an image forming unit 100Y that forms a yellow toner image, an image forming unit 100M that forms a magenta toner image, an image forming unit 100C that forms a cyan toner image, a transfer device 200, a fixing device 410, and a paper feed device 400. Inside the image forming apparatus body 12, a transport path 500 is also disposed to transport sheets used as recording media.

The image forming apparatus body 12 has an output port 14 from which sheets are output. The image forming apparatus body 12 is also equipped with an output tray 16 used as an output unit into which sheets are output after image formation.

Since the image forming units 100K, 100Y, 100M, and 100C have the same structure, they will be collectively described below as image forming units 100. As illustrated in FIG. 1, the image forming units 100 adopt an electrophotographic system, and each include a photoconductor 102 shaped like, for example, a cylinder, a charging device 110, a latent-image forming device 120, a developing device 130, and a cleaning device 140. The photoconductor 102 is used as an image carrier that bears an image made of toner. The charging device 110 serves as a charging unit that charges the photoconductor 102. The latent-image forming device 120 forms an electrostatic latent image on a surface of the photoconductor 102 charged by the charging device 110 by irradiating the surface of the photoconductor 102 with light. The developing device 130 serves as a developing unit that forms a toner image on the surface of the photoconductor 102 by developing the latent image formed on the photoconductor 102 with developer containing toner. The cleaning device 140 serves as a cleaning unit that cleans the photoconductor 102 after the toner image is transferred by the transfer device 200 onto an intermediate transfer body 210 to be described later.

The transfer device 200 includes a belt-shaped intermediate transfer body 210 serving as a transferred member that bears an image. For example, the intermediate transfer body 210 has an endless shape, and is supported by six support rollers 220, 222, 224, 226, 228, and 230 to be rotatable.

At least one of the six support rollers is used as a driving roller that transmits driving to the intermediate transfer body 210. In the first exemplary embodiment, the support roller 230 is used as the driving roller. A driving source 234, such as a motor, is connected to the support roller 230. The support roller 226 is used as an opposed roller opposed to a second transfer roller 250 with the intermediate transfer body 210 interposed therebetween.

The transfer device 200 includes first transfer rollers 240K, 240Y, 240M, and 240C used as first transfer members. The first transfer rollers 240K, 240Y, 240M, and 240C are each arranged inside the intermediate transfer body 210 to be opposed to any of the four photoconductors 102 with the intermediate transfer body 210 interposed therebetween. A first transfer bias is applied to the first transfer rollers 240K, 240Y, 240M, and 240C, and color toner images are transferred from the four photoconductors 102 onto the intermediate transfer body 210 by the first transfer rollers 240K, 240Y, 240M, and 240C. The first transfer rollers 240K, 240Y, 240M, and 240C are sometimes generically referred to as first transfer rollers 240.

The transfer device 200 further includes a second transfer roller 250. The second transfer roller 250 is used as a rotating body in contact with the intermediate transfer body 210 to form a transfer region N where a toner image is transferred from the intermediate transfer body 210 onto a sheet. A second transfer bias is applied to the second transfer roller 250, and the toner image is transferred from the intermediate transfer body 210 onto the sheet by the second transfer roller 250. The second transfer roller 250 is pressed against the intermediate transfer body 210 by, for example, an unillustrated pressing mechanism.

The fixing device 410 includes a heating unit 430 having a heat source therein, and a pressing unit 412 in contact with the heating unit 430. A toner image transferred on a sheet is fixed on the sheet by being heated and pressed at a contact portion (pressing region 470) between the heating unit 430 and the pressing unit 412. The fixing device 410 will be described in detail later.

The paper feed device 400 supplies sheets toward the transfer region N. The paper feed device 400 includes a sheet container 402 in which sheets are contained in a stacked state, and a feeding roller 404 that feeds out the sheets from the sheet container 402.

Through the transport path 500, a sheet is transported from the paper feed device 400 toward the transfer region N, is transported from the transfer region N toward the fixing device 410, and is output from the inside of the image forming apparatus body 12. Near the transport path 500, the above-described feeding roller 404, a transport roller 510, a registration roller 520, the above-described second transfer roller 250, and the above-described fixing device 410 are arranged in order along the transport path 500 from the upstream side in the sheet transport direction.

The registration roller 520 temporarily stops movement of a leading edge of a sheet transported toward the transfer region N, and restarts the movement of the leading edge of the sheet toward the transfer region N in timing to transportation of a toner image on the intermediate transfer body 210 to the transfer region N.

Next, the fixing device 410 according to the first exemplary embodiment will be described with main reference to FIG. 2. As illustrated in FIG. 2, the fixing device 410 includes the pressing unit 412 and the heating unit 430 opposed to the pressing unit 412. The heating unit 430 includes a sheet-shaped heat generator 440 serving as a heat generating member, and a heating member 432 heated by the sheet-shaped heat generator 440 and having an outer shape like a cylindrical endless belt. For example, the heating member 432 has a multilayer structure.

The pressing unit 412 includes a cylindrical roller part 414, and is opposed to the heating unit 430. The pressing unit 412 is pressed against an outer surface of the heating member 432 of the heating unit 430, and is rotated in a direction of arrow A in FIG. 1 by an unillustrated driving unit. The pressing unit 412 and a holding member 434 of the heating unit 430 constitute a pressing region 470 while clamping the heating member 432. By passing a recording medium having an unfixed toner image through this pressing region 470, the unfixed toner image is fixed on the recording medium by the application of heat and pressure.

The roller part 414 is a so-called soft roller including a shaft portion 416 made of a metal material such as iron, stainless steel, or aluminum, an elastic layer 418 covering the shaft portion 416, and a release layer 420 coated or applied on the elastic layer 418. The release layer 420 is made of an insulating material having high releasability, for example, PFA.

The roller part 414 of the pressing unit 412 is grounded. In the first exemplary embodiment, the roller part 414 is grounded from the shaft portion 416 through a pressing-unit resistor 422. By thus grounding the pressing unit 412 through the pressing-unit resistor 422, current leakage (leakage current) from an electrode of the sheet-shaped heat generator 440 in the heating unit 430 is suppressed.

In the pressing unit 412, the roller part 414 is pressed against the heating unit 430 by a pressing member constituted by an elastic body such as a coil spring (not illustrated). For example, the pressing member is attached at one end to the shaft portion 416, and is attached at the other end to the image forming apparatus body 12.

The heating unit 430 includes the heating member 432, and includes, inside the heating member 432, a sheet-shaped heat generator 440 serving as a heat generating member for heating the heating member 432, a holding member 434 that holds the sheet-shaped heat generator 440, and a frame member 452 that supports the holding member 434. The holding member 434 is supported by the frame member 452 to withstand the pressure from the pressing unit 412.

The heating member 432 of the heating unit 430 has an outer shape like a cylindrical endless belt, and, for example, has a multilayer structure. Both longitudinal ends of the heating member 432 are provided with, for example, circular support members (not illustrated) for supporting the heating member 432. The support members have heating-unit gears (not illustrated) for rotating the heating member 432. One of the heating-unit gears is connected to a driving unit (not illustrated), such as a motor, disposed inside the image forming apparatus body 12. The heating member 432 is rotated in a direction of arrow C, and heats a developer image on a sheet transported in a direction of arrow B (see FIG. 1).

Figure 3:
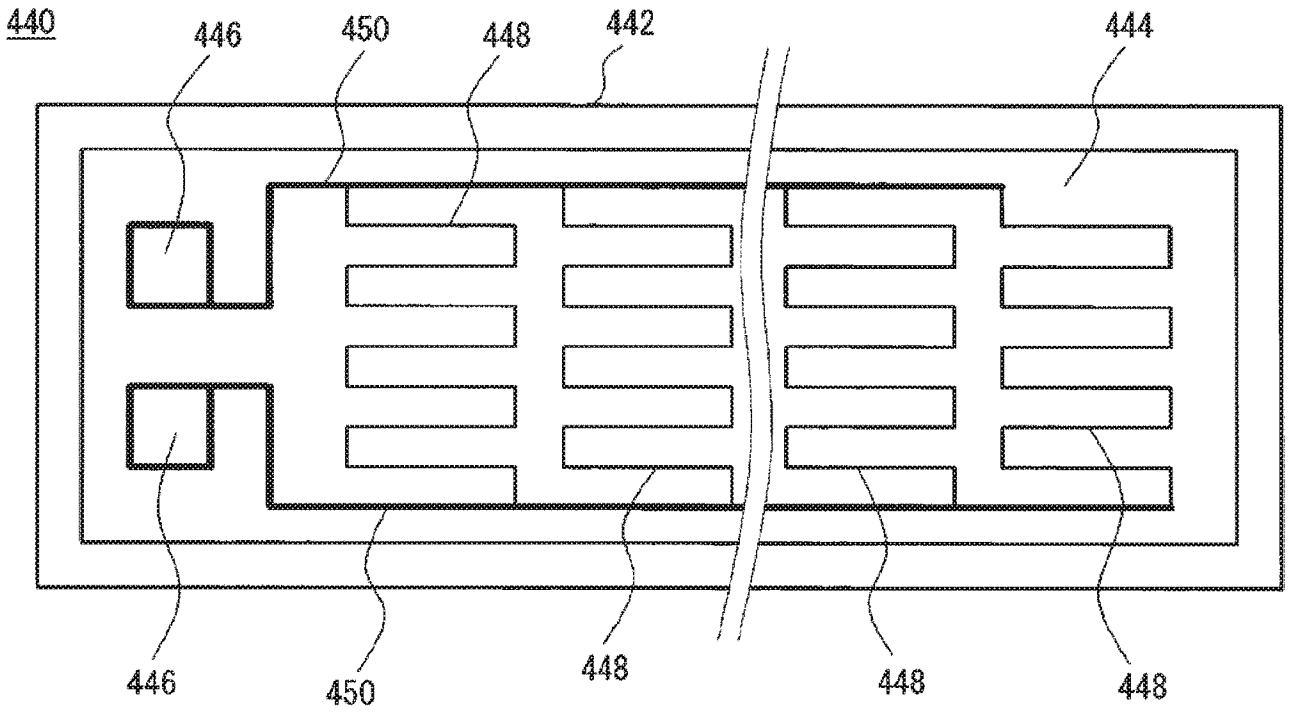
FIG. 3 is a plan view of a surface-shaped heat generator serving as a heat generating member according to the first to fourth exemplary embodiments.

As illustrated in FIG. 3, the sheet-shaped heat generator 440 serving as the heat generating member is constituted by a plate having a predetermined area and extending long in the longitudinal direction of the heating unit 430. The sheet-shaped heat generator 440 includes an electrically insulating base 442, an insulating layer 444 made of, for example, a polyimide-based heat resistant resin, a pair of electrodes 446 for power feeding, and resistance heating portions 448 made of, for example, stainless steel and caused to generate heat when power is supplied thereto from the electrodes 446. The electrodes 446 and the resistance heating portions 448 are connected by power feeding portions 450, and the electrodes 446, the power feeding portions 450, and the resistance heating portions 448 are embedded in the insulating layer 444.

The electrodes 446 in the sheet-shaped heat generator 440 are grounded. In the first exemplary embodiment, the electrodes 446 are connected to the ground through a heating-unit resistor 462. A section of the sheet-shaped heat generator 440 from the electrodes 446 to the ground serves as a potential-difference application unit 460.

For example, the holding member 434 is made of a highly heat-resistant resin material such as LCP (liquid crystal polymer). A side of the holding member 434 opposed to the pressing unit 412 has a groove 436 extending in the longitudinal direction to hold the sheet-shaped heat generator 440.

The holding member 434 forms a pressing region 470 by being pressed against the pressing unit 412 with the sheet-shaped heat generator 440 held in the groove 436.

The frame member 452 is made of, for example, a metal material, and supports the holding member 434. Both ends of the frame member 452 are fixed to a support member (not illustrated) so that the holding member 434 withstands the pressure from the pressing unit 412. The heating unit 430 may include, for example, a thermistor for temperature detection.

In the heating unit 430 of the first exemplary embodiment, the electrodes 446 of the sheet-shaped heat generator 440 are set, and the potential-difference application unit 460 is disposed between the electrodes 446 and the ground. The potential-difference application unit 460 is disposed so that the potential between the electrodes 446 of the heating unit 430 and the ground is higher than the potential between the shaft portion 416 of the pressing unit 412 and the ground.

In the heating unit 430 of the first exemplary embodiment, a heating-unit resistor 462 is used as the potential-difference application unit 460, and is disposed between the electrodes 446 of the sheet-shaped heat generator 440 and the ground.

The resistance value of the heating-unit resistor 462 is set so that the resistance value of the section between the electrodes 446 of the heating unit 430 and the ground, where the heating-unit resistor 462 is disposed, is higher than the resistance value of the section between the shaft portion 416 of the pressing unit 412 and the ground where the pressing-unit resistor 422 is disposed.

Specifically, when the resistance value of the pressing-unit resistor 422 is R1 and the resistance value of the heating-unit resistor 462 is R2, the resistance value R1 is set to be smaller than the resistance value R2. By thus setting the resistance values, the potential of the heating unit 430 is made higher than the potential of the pressing unit 412.

It is only required to set the potential difference so that the total potential between the electrodes 446 of the heating unit 430 and the ground is higher than the total potential between the shaft portion 416 of the pressing unit 412 and the ground. For that purpose, depending on the conditions of the resistance values of wires through which the heating unit 430 and the pressing unit 412 are grounded, the resistance value R1 of the pressing-unit resistor 422 may be sometimes equal to or higher than the resistance value R2 of the heating-unit resistor 462.

Second Exemplary Embodiment

In the fixing device 410 of the image forming apparatus 10 according to the first exemplary embodiment, the heating unit 430 and the pressing unit 412 are each grounded, and the heating-unit resistor 462 is disposed as the potential-difference application unit 460 in the heating unit 430. In a fixing device 410A of an image forming apparatus 10A according to a second exemplary embodiment, a heating unit 430 and a pressing unit 412 are commonly grounded. Structures common to the first exemplary embodiment are denoted by the same reference numerals, and detailed descriptions thereof are skipped.

Figure 4:
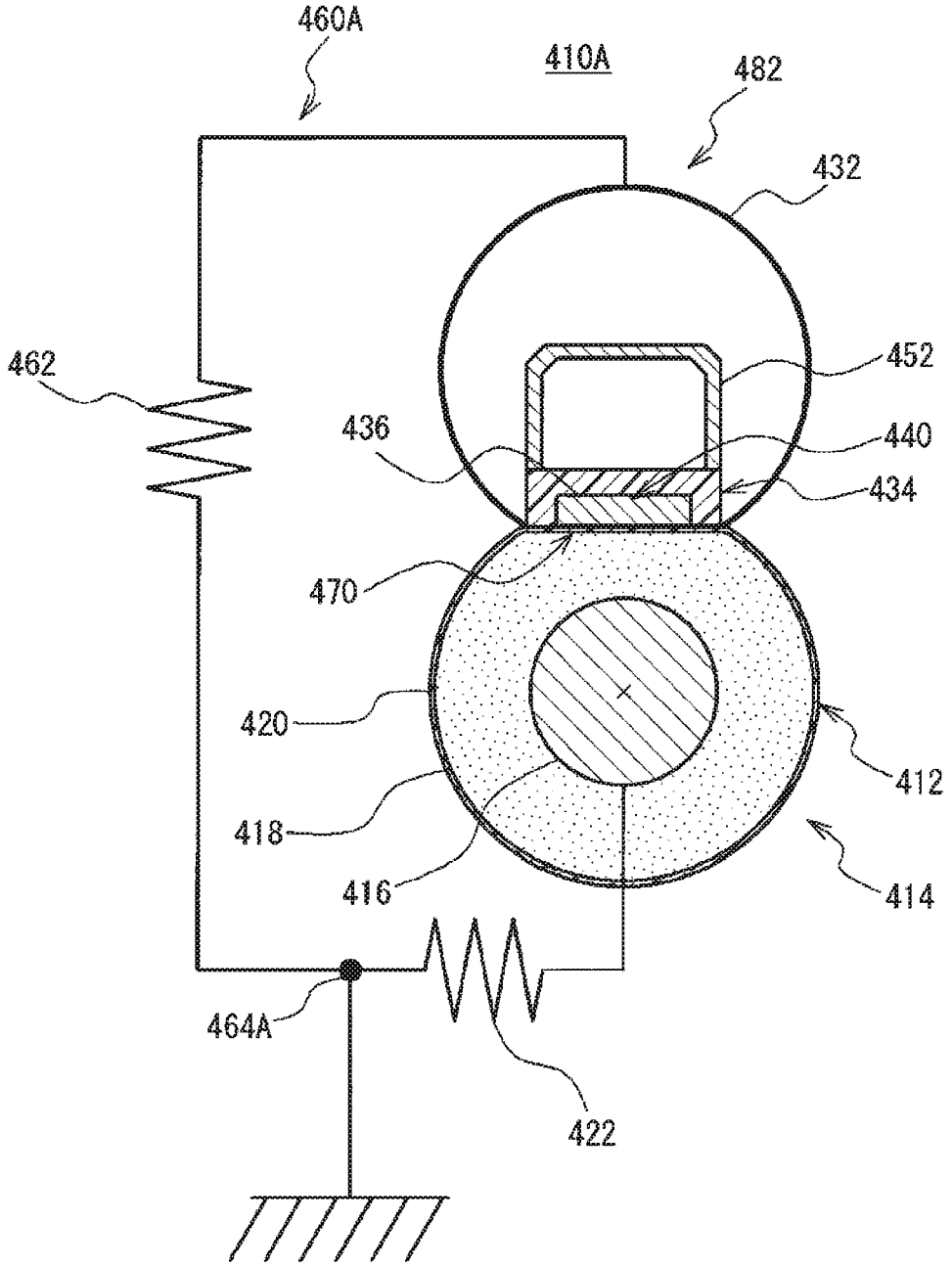
FIG. 4 is a sectional side view of a fixing device according to the second exemplary embodiment.

That is, as illustrated in FIG. 4, a wire for grounding in the heating unit 430 and a wire for grounding in the pressing unit 412 in the fixing device 410A are connected into one wire at a connecting portion 464A, and the heating unit 430 and the pressing unit 412 are then grounded.

At this time, a heating-unit resistor 462 is disposed as a potential-difference application unit 460A at a position closer to the heating unit 430 than the connecting portion 464A where the wires are connected, and a pressing-unit resistor 422 is disposed at a position closer to the pressing unit 412 than the connecting portion 464A.

In the second exemplary embodiment, similarly to the first exemplary embodiment, a resistance value R2 of the heating-unit resistor 462 serving as the potential-difference application unit 460A is set to be higher than a resistance value R1 of the pressing-unit resistor 422 (R1<R2). This makes the potential of the heating unit 430 higher than the potential of the pressing unit 412.

In the potential-difference application unit 460A of the second exemplary embodiment, similarly to the first exemplary embodiment, the resistance value R1 of the pressing-unit resistor 422 may sometimes be equal to or higher than the resistance value R2 of the heating-unit resistor 462, depending on the condition of wiring to the ground in the heating unit 430.

Third Exemplary Embodiment

Figure 5:
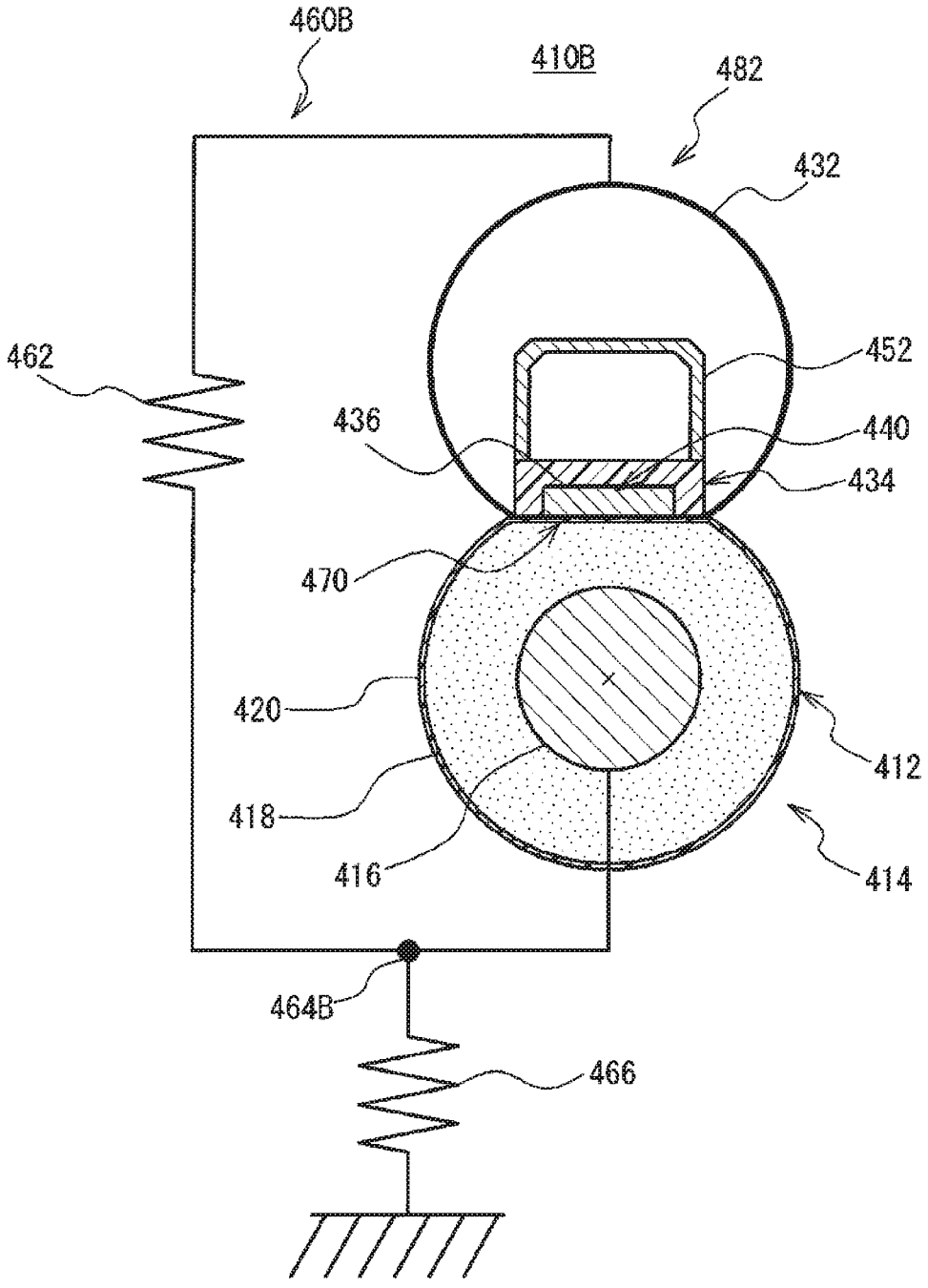
FIG. 5 is a sectional side view of a fixing device according to the third exemplary embodiment.

A fixing device 410B of an image forming apparatus 10B according to a third exemplary embodiment is common to the second exemplary embodiment in that, as illustrated in FIG. 5, a grounding wire of a heating unit 430 and a grounding wire of a pressing unit 412 are connected at a connecting portion 464B and a heating-unit resistor 462 is disposed as a potential-difference application unit 460B is disposed in the wire of the pressing unit 412, but is different from the second exemplary embodiment in that a pressing-unit resistor is not disposed on the way to the connecting portion 464B in the pressing unit 412 and another resistor 466 is disposed between the connecting portion 464B and the ground. Structures common to the first exemplary embodiment are denoted by the same reference numerals, and detailed descriptions thereof are skipped.

When a resistance value of the resistor 466 is taken as R3, the path of the heating unit 430 passes through a resistance value R2 of the heating-unit resistor 462 and the resistance value R3 of the resistor 466 (R2+R3), whereas the path of the pressing unit 412 passes only through the resistance value R3 of the resistor 466.

In the third exemplary embodiment, the resistance value R2 of the heating-unit resistor 462 and the resistance value R3 of the resistor 466 may be arbitrarily determined since the resistance value of the path of the heating unit 430 is constantly higher than the resistance value of the path of the pressing unit 412.

Fourth Exemplary Embodiment

Figure 6:
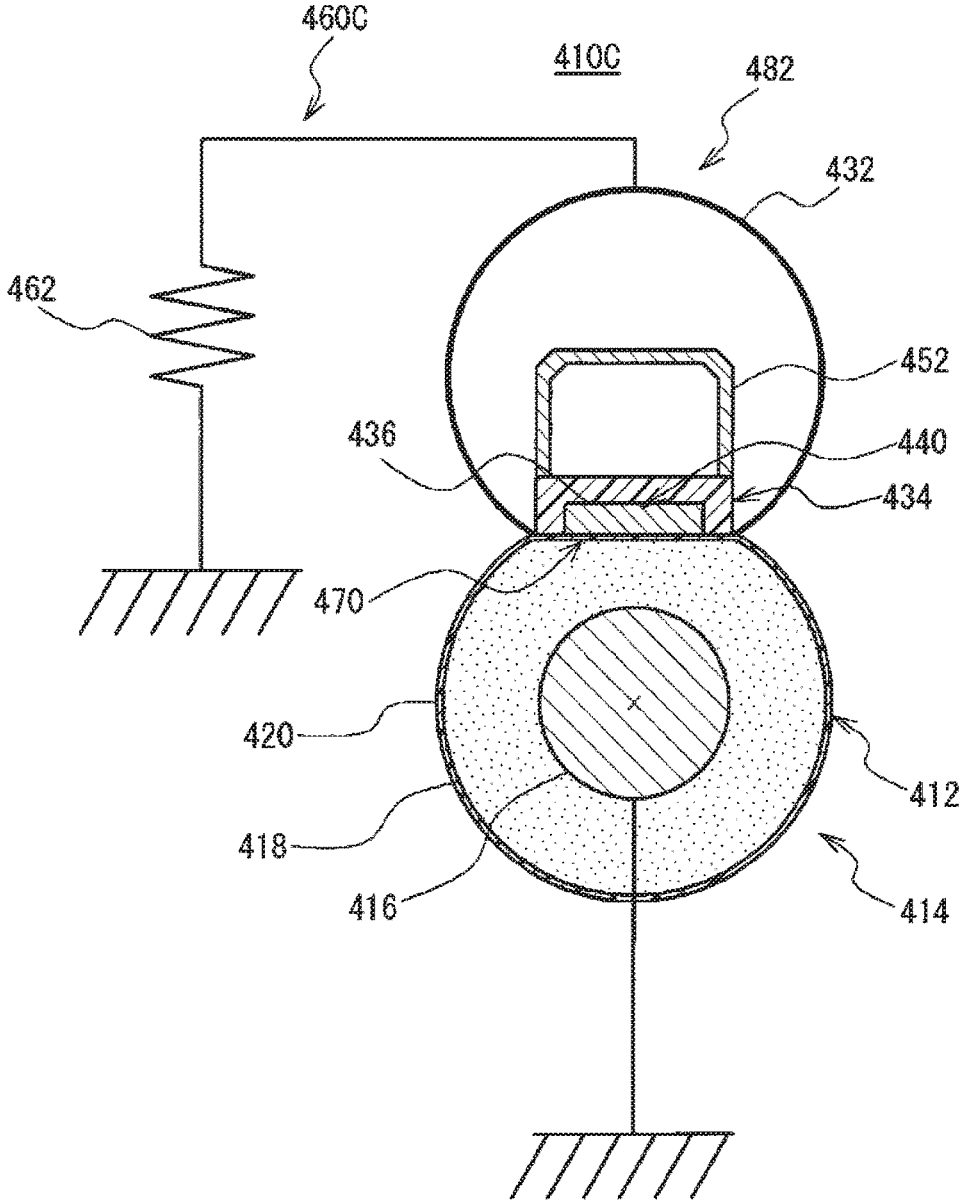
FIG. 6 is a sectional side view of a fixing device according to the fourth exemplary embodiment.

In a fixing device 410C of an image forming apparatus 10C according to a fourth exemplary embodiment, as illustrated in FIG. 6, a heating unit 430 is grounded through a heating-unit resistor 462 serving as a potential-difference application unit 460C so that the potential of the heating unit 430 is higher than the potential of a pressing unit 412, whereas the pressing unit 412 is grounded without any resistor. Structures common to the first exemplary embodiment are denoted by the same reference numerals, and detailed descriptions thereof are skipped.

While the sheet-shaped heat generator 440 is used as the heat generating member in the heating unit 430 according to the first to fourth exemplary embodiments, a heat generating member may be embedded in the cylindrical heating member 432 shaped like an endless belt to constitute a heat-generating rotating body in which the heat generating member itself generates heat. The heat-generating rotating body is grounded through the heating-unit resistor 462 serving as the potential-difference application unit 460.

For example, a carbon lamp heater or a halogen lamp heater may be used as the heat generating member in the heating unit 430, and plural heat generating members, for example, two heating rollers may be disposed so that one of the heating rollers is disposed inside the heating member and the other heating roller is disposed outside the heating member. These heating members or heat generating members are grounded through the heating-unit resistor 462 serving as the potential-difference application unit 460.

Figure 7:
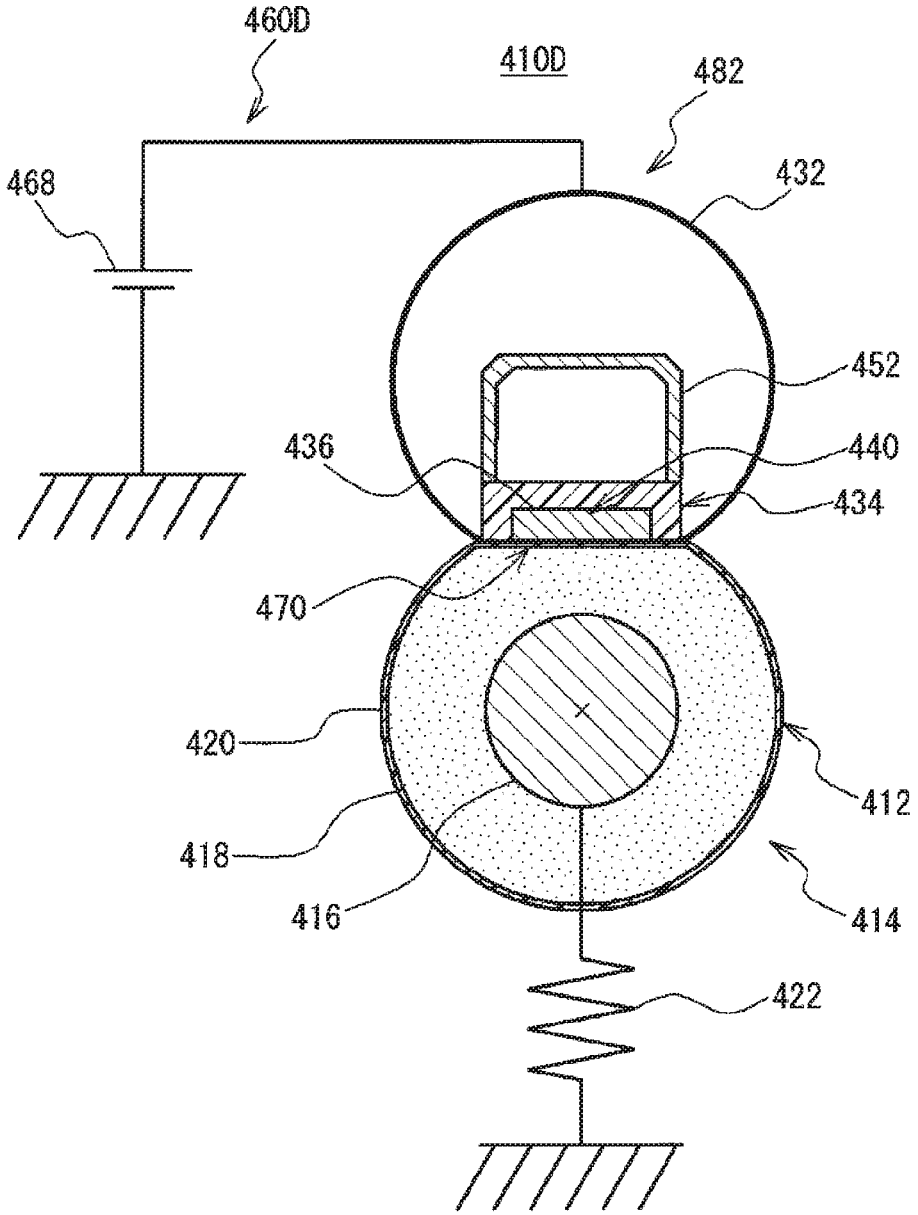
FIG. 7 is a sectional side view of another example of a fixing device.

As the potential-difference application unit, instead of the above-described resistor, another power supply 468 may be connected as a potential-difference application unit 460D to a heating unit 430 as in a fixing device 410D of an image forming apparatus 10D illustrated in FIG. 7. A bias voltage is applied from the power supply 468 to the heating unit 430 so that the potential of the heating unit 430 is higher than the potential of a pressing unit 412.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating unit configured to rotate and fix a toner image on a recording medium;

a pressing unit configured to rotate and press the heating unit; and a potential-difference application unit configured to apply a potential difference between the pressing unit and the heating unit so that an absolute value of a potential of the heating unit is higher than an absolute value of a potential of the pressing unit, wherein the pressing unit is grounded, wherein the heating unit is grounded through the potential-difference application unit, wherein the pressing unit is grounded through a pressing-unit resistor having a predetermined resistance value, and wherein the potential-difference application unit is a heating-unit resistor having a resistance value higher than the resistance value of the pressing-unit resistor.

2. The fixing device according to claim 1, wherein the heating unit includes a sheet-shaped heat generator.

3. A fixing device comprising:

a heating unit configured to rotate and fix a toner image on a recording medium;

a pressing unit configured to rotate and press the heating unit; and a potential-difference application unit configured to apply a potential difference between the pressing unit and the heating unit so that an absolute value of a potential of the heating unit is higher than an absolute value of a potential of the pressing unit, wherein the heating unit and the pressing unit are grounded after being connected into one wire by a connecting portion, and wherein the heating unit reaches the connecting portion through the potential-difference application unit.

4. The fixing device according to claim 3, wherein the potential-difference application unit comprises a heating-unit resistor having a predetermined resistance value.

5. The fixing device according to claim 4, wherein the pressing unit reaches the connecting portion through a pressing-unit resistor having a predetermined resistance value.

6. The fixing device according to claim 3, wherein the pressing unit reaches the connecting portion through a pressing-unit resistor having a predetermined resistance value.

7. The fixing device according to claim 3, wherein the pressing unit reaches the connecting portion through a pressing-unit resistor having a predetermined resistance value, and wherein the potential-difference application unit comprises a heating-unit resistor having a resistance value higher than the resistance value of the pressing-unit resistor.

8. The fixing device according to claim 3, wherein another resistor is provided between the connecting portion and a ground.

9. An image forming apparatus comprising:

an image forming unit configured to form a toner image on a recording medium;

a heating unit configured to rotate and fix the toner image formed on the recording medium by the image forming unit;

a pressing unit configured to rotate and press the heating unit; and a potential-difference application unit configured to apply a potential difference between the pressing unit and the heating unit so that an absolute value of a potential of the heating unit is higher than an absolute value of a potential of the pressing unit, wherein the pressing unit is grounded, wherein the heating unit is grounded through the potential-difference application unit, wherein the pressing unit is grounded through a pressing-unit resistor having a predetermined resistance value, and wherein the potential-difference application unit is a heating-unit resistor having a resistance value higher than the resistance value of the pressing-unit resistor.

* * * * *